US006575463B1

(12) United States Patent
Wintersteen

(10) Patent No.: US 6,575,463 B1
(45) Date of Patent: Jun. 10, 2003

(54) GLADIATOR GAME AND METHOD OF PLAY

(76) Inventor: Lance W. Wintersteen, P.O. Box 159, Astor, FL (US) 32102

( * ) Notice: Subject to any disclaimer, the term of this patent is extended or adjusted under 35 U.S.C. 154(b) by 0 days.

(21) Appl. No.: 10/114,015

(22) Filed: Apr. 1, 2002

(51) Int. Cl.[7] ..... A63F 3/00

(52) U.S. Cl. ..... 273/261; 273/255; 273/260; 273/262; 273/236

(58) Field of Search ..... 273/255, 260, 273/261, 284, 262, 236

(56) References Cited

U.S. PATENT DOCUMENTS

| | | | | | |
|---|---|---|---|---|---|
| 3,963,242 | A | * | 6/1976 | Treugut et al. | 273/261 |
| 4,261,574 | A | * | 4/1981 | Rogers, Jr. | 273/253 |
| 4,309,036 | A | * | 1/1982 | Alvey | 273/248 |
| 4,534,567 | A | * | 8/1985 | Ferris et al. | 273/255 |
| 4,688,802 | A | * | 8/1987 | Sandifer | 273/261 |
| 4,695,056 | A | * | 9/1987 | Cornelson et al. | 273/262 |
| 5,026,070 | A | * | 6/1991 | Watt | 273/261 |
| 5,033,753 | A | * | 7/1991 | Yuen et al. | 273/261 |
| 5,150,908 | A | * | 9/1992 | Codinha | 273/262 |
| 5,251,905 | A | * | 10/1993 | Bombino | 273/255 |
| 5,388,837 | A | * | 2/1995 | Hoffman | 273/262 |
| 5,443,268 | A | * | 8/1995 | Mayfield et al. | 273/241 |
| 5,484,157 | A | * | 1/1996 | King | 273/260 |
| 5,496,037 | A | * | 3/1996 | Rumph | 273/255 |
| 5,791,987 | A | * | 8/1998 | Chen et al. | 463/9 |
| 6,070,871 | A | * | 6/2000 | Wilson et al. | 273/261 |
| 6,450,498 | B1 | * | 9/2002 | Rombone | 273/255 |
| 6,481,714 | B1 | * | 11/2002 | Jacobs | 273/236 |

FOREIGN PATENT DOCUMENTS

GB 2 191 952 A * 12/1987 ..... A63F/3/02

OTHER PUBLICATIONS

Mark A.Jacobs—Battle Card From, and Method for Using the Card in, a Board Game—Feb. 20, 2003—Pub. No.: US 2003/0034606 A1.*

Meetul Kinarivala—Board Game Apparatus And Method of Play—Mar. 20, 2003—Pub. No.: US 2003/0052451 A1.*

* cited by examiner

*Primary Examiner*—Benjamin H. Layno
*Assistant Examiner*—Dolores R. Collins
(74) *Attorney, Agent, or Firm*—Paul S. Rooy, P.A.

(57) ABSTRACT

A gladiator game and method of play. The gladiator game comprises a game environment, player tokens, gladiator tokens, trainer tokens, a stack of monster cards, a stack of treasure cards, play money, and a chance device. The chance device determines player token moves over spaces disposed in a perimeter path around an arena. Under certain conditions, gladiator tokens may be purchased (representing the retention of a Gladiator), and may enter the arena. In the arena different gladiators may engage in combat, the outcome being determined by a number of factors including their gladiator attack points, gladiator defense points, and the chance device. A gladiator token occupying a center spot in the arena earns play money for its owner every turn, and additional play money is earned each circuit of the perimeter path. Video game, computer game, and internet versions of the instant game are considered to be within the scope if the instant invention. The internet version permits large number of players to participate simultaneously, and new players may join the game at any time.

22 Claims, 5 Drawing Sheets

GLADIATOR GAME AND METHOD OF PLAY

BACKGROUND OF THE INVENTION

1. Field of the Invention

This invention relates to combat games, and in particular to a gladiator game and method of play.

2. Background of the Invention

Games simulating combat are some of the most exciting games available for play. Within this genre, it is difficult to envision a more interesting combat game than a gladiators game, complete with Avatars, Exotic Beasts, and Dragons!

At the same time, given the popularity of internet games which are playable by a large number of participants simultaneously, it would be desirable to provide a gladiators game and method of play which can be played on the internet jointly by a many players, and which fresh players may join into at any time.

SUMMARY OF THE INVENTION

Accordingly, it is an object of the present invention to provide a gladiator game which simulates actual arena combat. Design features allowing this object to be accomplished include a game environment having a perimeter path and an arena, player tokens, gladiator tokens, and a chance device. Advantages associated with the accomplishment of this object include enhanced entertainment and realism.

It is another object of the present invention to provide a gladiator game and method of play which can be joined into by a large number of players. Design features allowing this object to be accomplished include a bank, play money, and a large number of player tokens. Benefits associated with the accomplishment of this object includes the ability for large numbers of players to participate over an internet, and the associated enjoyment by the players.

It is an object of the present invention to provide a gladiator game and method of play which can be joined into at any time by fresh players. Design features allowing this object to be accomplished include a bank, play money, and a large number of player tokens. Benefits associated with the accomplishment of this object includes the ability for large numbers of players to participate, and the associated enjoyment by the players.

BRIEF DESCRIPTION OF THE DRAWINGS

The invention, together with the other objects, features, aspects and advantages thereof will be more clearly understood from the following in conjunction with the accompanying drawings.

Five sheets of drawings are provided. Sheet one contains FIG. 1. Sheet two contains FIGS. 2 and 3. Sheet three contains FIGS. 4 and 5. Sheet four contains FIGS. 6 and 7. Sheet five contains FIGS. 8 and 9.

DETAILED DESCRIPTION OF THE PREFERRED EMBODIMENT

Figure 1:
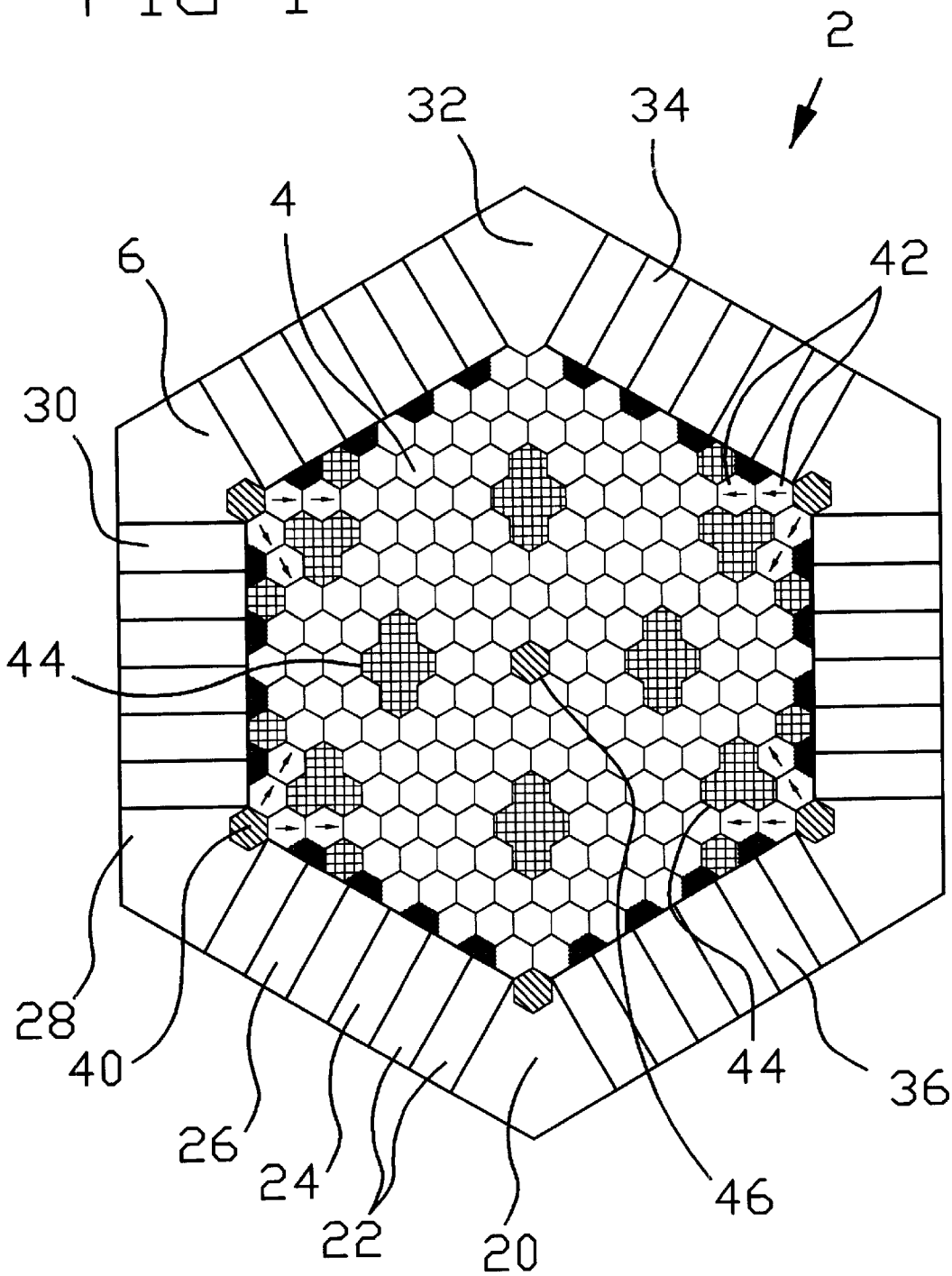
FIG. 1 is a top view of a game environment.

Referring now to FIG. 1 we observe a top view of game environment 2. Game environment 2 comprises perimeter path 6 surrounding arena 4. Perimeter path 6 comprises a plurality of perimeter path 6 spaces, including one or more of the following: main office space 20, gladiator space 22, monster card space 24, treasure card space 26, entrance space 28, unauthorized fighting space 30, retain a trainer space 32, your best gladiator retires space 34, portal space 36, etc.

In the preferred embodiment the following was the order of perimeter path 6 spaces proceeding clockwise around perimeter path 6:

main office space 20
Entertainment gladiator space 22
Footman gladiator space 22
monster card space 24
Swordsman gladiator space 22
treasure card space 26
Exotic Beast gladiator space 22
entrance space 28
monster card space 24
Slave gladiator space 22
Javlinist gladiator space 22
Soldier 1st Class gladiator space 22
unauthorized fighting space 30
Martial Artist gladiator space 22
entrance space 28
Convict gladiator space 22
treasure card space 26
Soldier 3rd Class gladiator space 22
monster card space 24
Long Bowman gladiator space 22
Paladin gladiator space 22
retain a trainer space 32
Savage gladiator space 22
your best gladiator retires space 34
Archer gladiator space 22
Gladiator gladiator space 22
Avatar gladiator space 22
monster card space 24
entrance space 28
Squire gladiator space 22
monster card space 24
Soldier 2nd Class gladiator space 22
Warlord gladiator space 22
Dragon Slayer gladiator space 22
treasure card space 26
entrance space 28
Thief gladiator space 22
portal space 36
Mercenary gladiator space 22
Knight gladiator space 22
monster card space 24
Dragon gladiator space 22

Although a preferred embodiment distribution and order of perimeter path 6 spaces is given above, it is considered to be within the scope of this invention that any combination of one or more of the above identified types of perimeter path 6 spaces be used, in any distribution and/or order.

Arena 4 comprises arena 4 spots, which may include one or more of the following: entrance spot 40 (hatched green in FIG. 2), safety spot 42 (marked by an arrow in FIG. 2), thief sanctuary spot 44 (cross-hatched in FIG. 2), center spot 46 (hatched green in FIG. 2), etc.

Figure 2:
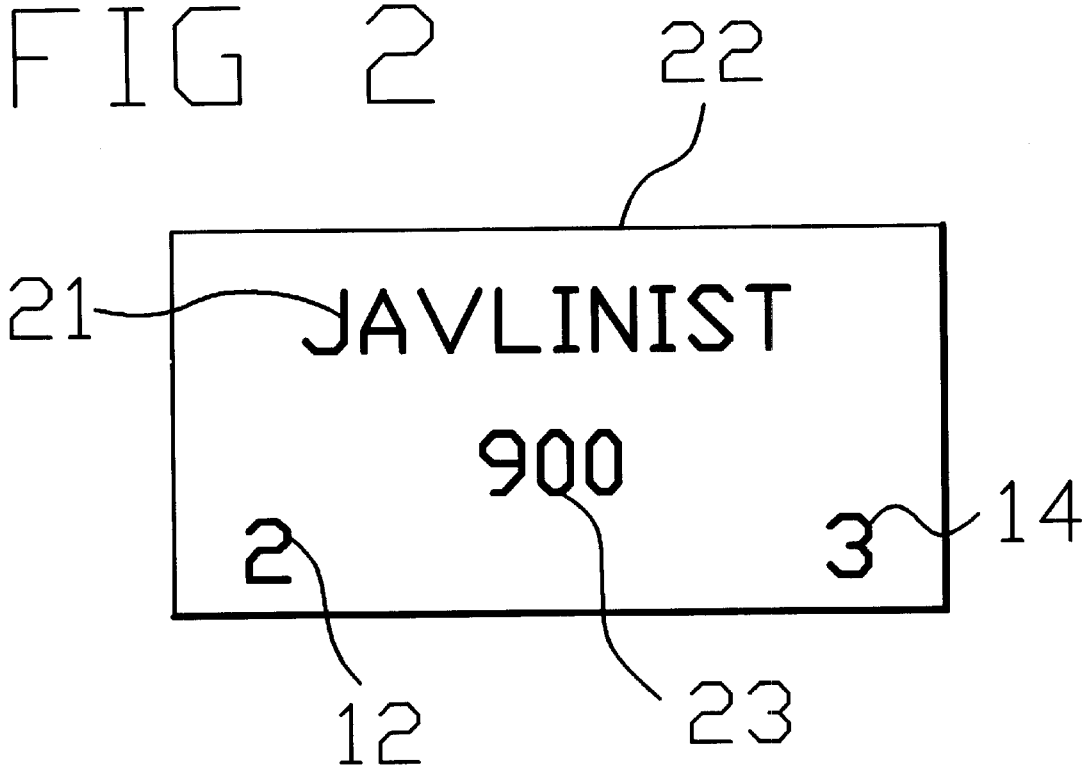
FIG. 2 is a top view of a perimeter path gladiator space.

FIG. 2 is a top view of a perimeter path gladiator space 22. Each gladiator space 22 comprises gladiator name 21

(Javlinist in FIG. 2), gladiator cost 23, gladiator attack points 12 and gladiator defense points 14. Gladiator cost 23 represents the cost to retain the gladiator identified by gladiator name 21. Gladiator attack points 12 specify the strength of the gladiator in attack, while gladiator defense points 14 specify the strength of the gladiator in defense.

Figure 3:
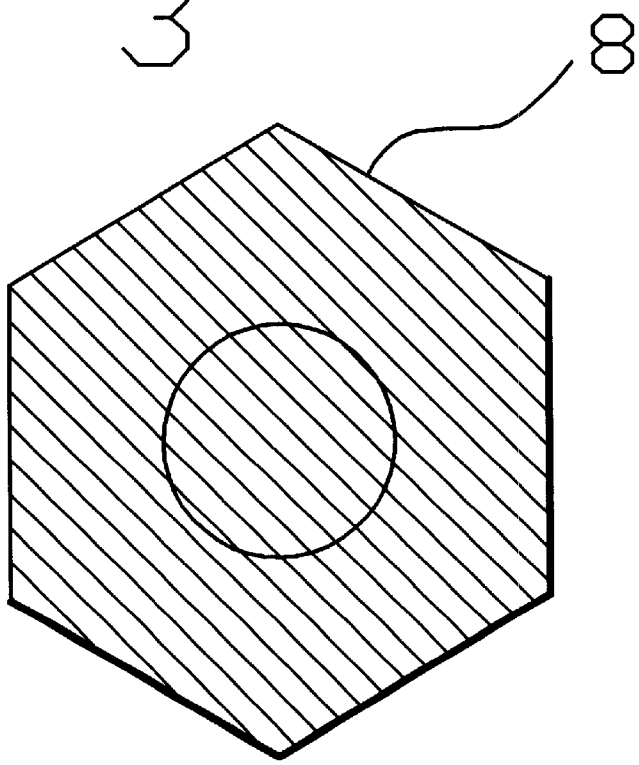
FIG. 3 is a top view of a player token.

FIG. 3 is a top view of player token 8 (hatched green in FIG. 3). A plurality of player tokens 8 are used in the instant game, and each differs from the others for ready identification. Each turn, player tokens 8 advance around perimeter path 6 by a number of spaces indicated by a chance device such as a die. Although in the preferred embodiment the chance device disclosed was one or more dice, it is considered to be within the scope if the instant invention that any chance device be used, including but not limited to dice, spinners, electronically generated random numbers (as may be the case in the electronic version of the instant game, which may be a video game, computer game, a game suitable for playing by many players on the internet, etc.).

Figure 4:
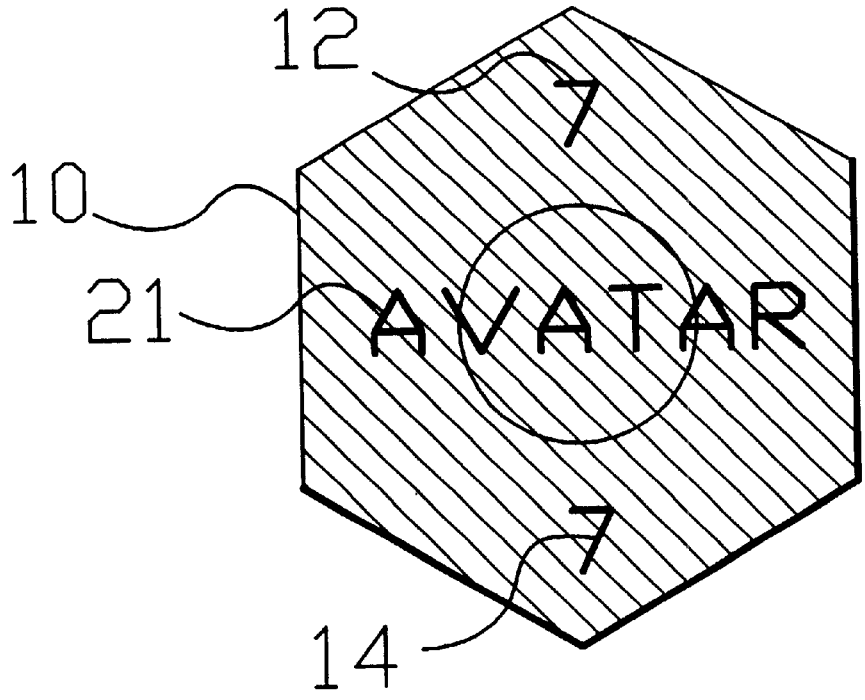
FIG. 4 is a top view of a gladiator token.

FIG. 4 is a top view of gladiator token 10 (hatched green in FIG. 3). Each gladiator token 10 comprises gladiator name 21 (Avatar in FIG. 4), gladiator attack points 12 and gladiator defense points 14. Gladiator attack points 12 specify the strength of the gladiator in attack, while gladiator defense points 14 specify the strength of the gladiator in defense.

Figure 5:
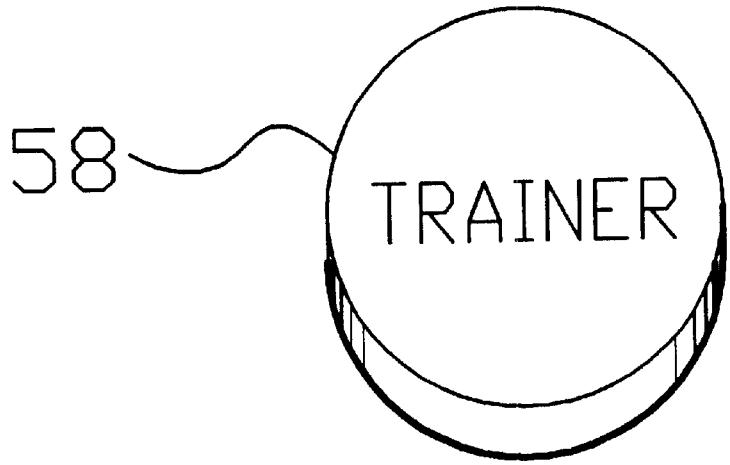
FIG. 5 is a top view of a trainer token.

FIG. 5 is a top view of trainer token 58.

Figure 6:
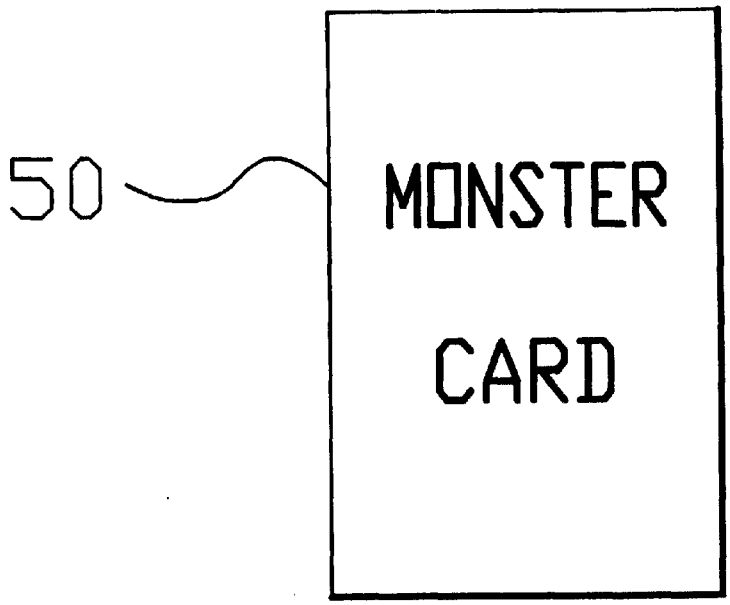
FIG. 6 is a top view of a monster card.
Figure 7:
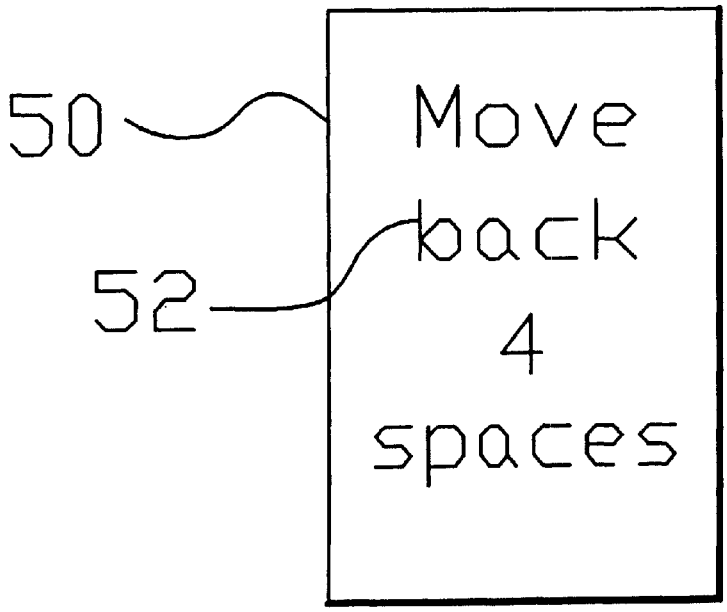
FIG. 7 is a bottom view of a monster card.

FIG. 6 is a top view of a monster card 50. FIG. 7 is a bottom view of a monster card 50, bearing monster card instructions 52.

Figure 8:
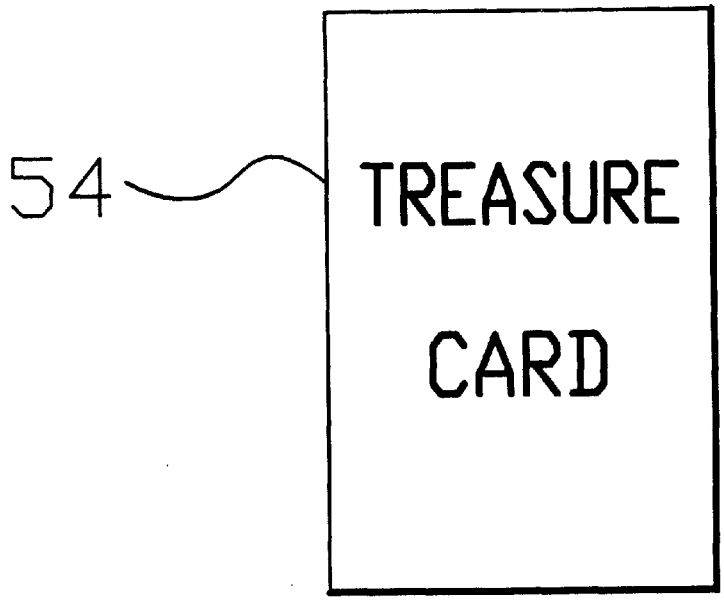
FIG. 8 is a top view of a treasure card.
Figure 9:
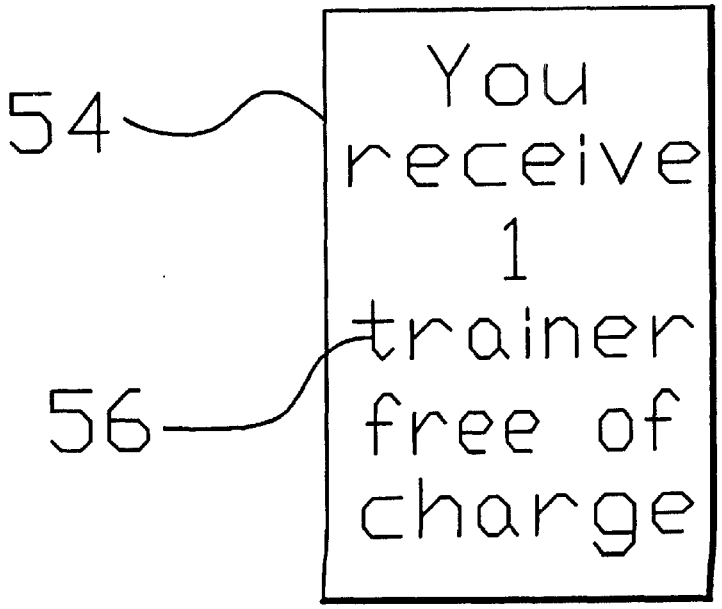
FIG. 9 is a bottom view of a treasure card.

FIG. 8 is a top view of a treasure card 54. FIG. 9 is a bottom view of a treasure card 54 bearing treasure card instructions 56.

An explanation of the apparatus and method of play follows. FIGS. 1–9 may be referred to for the purposes of this explanation.

The Storyline:

Ogmok, the Arena owner in an attempt to boost his profits, has decided to sponsor a tournament. So now twice a week he opens his Arena to a free-for-all. The grand prize winner received from Ogmok their choice of gladiator, retainer cost paid by Ogmok. The whole idea was a big hit. The citizens flocked to the arena, profits were up and the gladiator operators finally had a chance to flourish. Almost everybody wore a big smile.

The Object:

1.) With a designated number of Gladiators, to be the first player entered into arena 4 (the fighting portion of the Arena) with no other opponents to challenge your domination of arena 4.

2.) Choose a special gladiator to be in arena 4.

3.) Set a time limit and the player with the most gladiators in arena 4 at that time wins.

4.) Once familiar with the game, figure your own object.

Equipment:

Consists of game environment 2, chance device (which were at least two six-sided dice in the preferred embodiment), at least two player tokens 8; a number of Monster Cards 50; a number of Treasure Cards 54; a number of trainer tokens 58; a set of gladiator tokens 10 associated with each player token 8, and play money. In the preferred embodiment there were two white dice, one red die, one blue die, six player tokens 8, 32 Monster Cards 50, 16 Treasure Cards 54, and 24 gladiator tokens 10 associated with each player token 8.

Preparation:

Shuffle Monster Cards 50 and Treasure Cards 54, placing them to one side of game environment 2. Decide on a banker to perform the banking duties. Choose someone to manage Monster Cards 50 and Treasure Cards 54. Banker first rolls the dice for high roll. Player to the left of the banker is next in line to roll for high roll, etc. High roller starts by choosing the player token 8 he wishes to use in the game to mark his progress around the perimeter path 6. High roller starts first. Each Player is given gladiator tokens 10 corresponding to such Player's player token 8. The gladiator tokens 10 represent the gladiators allowed to be retained by such Player. Spread the gladiator tokens 10 out so they can be easily found. Each Player takes care of their own markers. Each player receives from the banker 1000 in gold to start the game with.

The Banker:

Select one player to be the Banker. A Banker who also plays in the game MUST keep his personal accounts separate from the Banks accounts. The banker will be responsible for all transactions between the bank and the players. Banker rolls the two white 6-sided dice first for high roll.

The Bank:

The Bank is owned by Ogmok and is the establishment where most transactions on playing environment 2 will take place. When retaining a Gladiator the money spent will go to The Bank. The Bank will also collect unauthorized fighting fines and all money due when drawing a card (Exception: when the money is to be paid to another player as stated on a card.).

The Bank is also responsible for paying any rewards due to a Player as a result of drawing a Monster Card 50 or Treasure Card 54, and giving the players a trainer token 58 when a trainer is retained, or paying the player at the time of crossing main office space 20 their path completion payment (400 in gold in the preferred embodiment). The bank will also pay a center spot payment to the gladiator who is stationed in The Arena center spot 46 (100 gold per turn in the preferred embodiment).

The Bank CAN NOT go broke. If there is not enough play money on hand, additional funds can be issued by The Bank at any time.

Loans through The Bank are NOT available and Players may not borrow, loan or give money, gladiator tokens 10 or trainer tokens 58 to any other Player.

All fines and bills are due immediately or as much as the Player has. Any or all, Gladiators or Trainers, already retained must be unretained for half the original retained price in order to pay as much of such Player's bill as possible. If the Player does not have the gold needed to meet the requirements he becomes bankrupt (see Bankruptcy).

Bankruptcy:

At the beginning of a Player's turn he may declare himself bankrupt and start over. To do so the Player:

1.) states to the Banker that he is declaring bankruptcy;

2.) the Player then turns over to the bank all assets he still has including cash, trainers, gladiators and any cards he may be holding;

3.) the Player moves his token to The Arena's main office space 20;

4.) end of turn.

The Play:

The Player who was high roller starts the play by placing his player token 8 on The Arena's main office space 20, then rolling the two white 6-sided dice and moving clockwise around perimeter path 6 the number of spaces equal to the pips shown on the rolled dice. After the first Player has completed he turn by performing the actions necessary or desired dictated by the space such Player's token 8 landed on, play passes to the next player to the left (clockwise).

Player tokens 8 remain on the last perimeter path 6 space occupied, and proceed from that space on the Player's next turn. Two or more player tokens 8 may occupy the same perimeter path 6 space. According to the perimeter path 6 space a given player token 8 reaches, the associated Player may be allowed to retain gladiators, enter a gladiator into the arena etc., or they may be obliged to draw a card or retire their gladiator, etc.

Retaining Gladiators:

. . . In order to retain a Gladiator a player token 8 must land on the gladiator space 22 corresponding to such Gladiator, and the Player who owns that player token 8 must pay the bank the gladiator cost 23 identified on the gladiator space 22. Upon receipt of appropriate payment, the Player is free to use the gladiator token 10 corresponding to the Gladiator he just purchased in combat in arena 4 in accordance with these rules.

Retaining a Gladiator is one of the most important aspects of the game. Gladiator retention strategy largely determines how the game proceeds. Gladiators are the actual fighting forces who will take there place in arena 4 to fight under a Player's banner in an attempt to claim center spot 40. Each Gladiator attacks and defends with different abilities (see Attack and Defense Chart:) giving advantages to the better opponent entered within arena 4. The better the Gladiator the more gold a Player will need to retain the services of that individual Gladiator. The gold a Player pays for the gladiator as retainer fee will be held by Ogmok (the bank). Any retained Gladiators go to the Player's stockpile to be used as desired by the Player (see The Players Stockpile:).

The Player's Stockpile:

Any retained gladiator tokens 10 are put in a separate pile from the rest of the gladiator tokens 10 that are available. These are the gladiators tokens 10 the Player will have a chance to enter into arena 4 when that Player's player token 8 lands on an entrance space 28, portal space 36, or main office space 20.

Doubles:

If a Player rolls doubles, he moves his player token 8 the pip total shown on the dice and performs any action associated with the perimeter path 6 space landed upon. The same Player now rolls again, moves his token, and performs the actions involved with his move. This ends his turn. Play passes to the next Player (Exception: when after the second roll the Player ends up with a card that tells him to roll again).

Doubles can also be used to enter a gladiator token 10 into arena 4. When doubles are rolled, the player token 8 is moved as usual and any action connected to the perimeter path 6 space landed upon performed. The same Player then has the opportunity to either roll again to move on around the perimeter path 6 OR that Player can decide to take a chance to enter a gladiator token 10 into arena 4. To enter a gladiator token 10 into arena 4 the Player must first choose the gladiator token 10 he wishes to risk. That gladiator token 10 is placed on the entrance space 28 closest to the that Player's player token 8. The Player must pay the bank the appropriate entrance fee (50 gold in the preferred embodiment), then using one six-sided die, roll a predetermined chance device range (1–4 in the preferred embodiment) for a successful entrance. A predetermined chance device value(s) (5 or a 6 in the preferred embodiment when the die is rolled) will kill the Gladiator and its corresponding gladiator token 10 is un-retained and no longer available to that Player until retained again later, in accordance with these rules. This ends the turn. Play passes to the next Player.

Same Space:

When two or more player tokens 8 end up occupying the same perimeter path 6 space, each Player has access to that location and may or must perform the actions necessary for that space.

Main Office Space 20:

This is the starting space on perimeter path 6. After the starting moves, each time a Player's token lands on or passes across main office space 20 that Player collects a path completion payment from the bank. In the preferred embodiment, the path completion payment was 400 gold. If a Player declares bankruptcy this is once again his starting space. A Player may enter gladiator token(s) 10 into arena 4 through main office space 20 free of charge.

Entrances Spaces 28:

When a player token 8 lands on any of the four entrance spaces 28, upon appropriate payment of an arena entrance fee (50 gold in the preferred embodiment) such Player enter any gladiator token 10 which has been previously retained by such Player onto the entrance spot 40 co-extensive with such entrance space 28. This ends that Player's turn unless doubles were involved. On the Player's next turn he has two options:

1.) roll the two white 6-sided dice to continue moving his player token 8 around perimeter path 6, or 2.) roll the two colored 6-sided dice to move (and possibly commit to combat) his gladiator token(s) 10 within arena 4. (see Arena 4:)

A gladiator token 10 that sits on an entrance spot 40 may be removed by any other player token 8 which lands on that entrance spot 4. Such removed gladiator token 10 is returned to the Player who owns it, and remains retained by such Player and is available for further use by such Player later.

Safety Spots 40:

At least one safety spot 40 separates each entrance spot 40 from the other arena 4 spots. A gladiator token 10 may NOT attack from a safety spot 40, nor can a gladiator token 10 be attacked while occupying a safety spot 40. Once a given gladiator token 10 departs from a safety spot 40 onto an arena 4 spot which is not a safety spot 40, such gladiator token 10 cannot subsequently move onto any safety spot 40.

Thief Sanctuary Spots 44:

Arena 4 further comprises thief sanctuary spots 44. Only thief gladiator tokens 10 may occupy thief sanctuary spots 44. (See Special Gladiators: The Thief). No gladiator token 10 may attack a thief gladiator token 10 occupying a thief sanctuary spot 44 except another thief gladiator token 10.

Center Spot 46:

Center spot 46 in arena 4 is controlled by having a gladiator token 10 sitting on that space. For each turn that a Player has a gladiator token 10 sitting on center spot 46 he may collect a center spot payment (100 gold in the preferred embodiment) before he rolls the dice at the beginning of his turn. Rolling doubles does NOT give a Player a second opportunity to collect the 100 gold because that Player's turn has already started.

Arena 4:

In the preferred embodiment, the blue and the red die are the dice used when a Player has decided to use his turn to move his gladiator token(s) 10 in arena 4. The blue die represents the movement and/or defense capabilities for a gladiator token 10 within arena 4, and the red die represents the attack capabilities of ALL the gladiators within the arena. Roll BOTH colored dice at one time and use the number of pips shown on the blue die to move in the arena, with the red die indicating the roll for attack if the situation calls for an attack.

Moving and Fighting Gladiators Tokens 10:

When more then one Player has a gladiator token 10 within arena 4 it is likely that a battle will commence (after all that is what Gladiators do). If at the beginning of a Player's turn he chooses to move and fight within arena 4, rather than move on around perimeter path 6 with his player token 8 (both may not be done on the same turn even if doubles were involved), then that Player must use the two colored dice. Play is rather straight-forward if only one gladiator token 10 from each Player is involved:

1.) activate the chance device (in the preferred embodiment, roll the two colored dice), 2) move a gladiator token 10 desired amount of spaces allowed by chance device (the pips shown on the blue die). A Player does not have to move at all if he does not think the timing is proper or he may move any portion of the move allowable*.

3.) the attack chance device value has already been determined (by roll of a red die in the preferred embodiment, or such other chance device as is being used), so using the number of pips shown on the red die as the base number, add any pluses that Gladiator receives due to his training and/or bonuses allowed by a trainer (see Retaining a Trainer:). If the Player's gladiator is within range for attacking the opponent's gladiator token 10 (on a spot adjacent the defending gladiator token 10, unless the particular attacking Gladiator has a longer attack range—see Special Gladiators below), then the number achieved by adding die pips, gladiator attack points 12 and bonuses is the number declared as the attack number and is the number the defending gladiator token must meet or exceed in order to prevail. A gladiator token 10 is within attack range if it occupies an arena 4 spot adjacent a gladiator token 10** to be attacked (Exception: Certain special gladiators are be within attack range if further away, e.g. the Javelin Thrower may attack from two spots away, the Archer can attack from three spots away, and the Longbowman can attack from four spaces away. See Special Gladiators, below).

4.) the defending Player makes any statements needed to be made (see Retaining a Trainer:) at this time, 5.) defender activates the chance device (the blue die in the preferred embodiment). This is NOT a movement roll, a defender can NOT move.

6.) defender adds chance device value, gladiator defense points, and bonuses to arrive at a defense number, 7.) if the defense number achieved by the defender is equal to or greater than the attack number achieved by the attacker, the attack has been successfully defended. No counter-attack is allowed at this time. If the defense number achieved by the defender is NOT equal to or greater than the number achieved by the attacker, the attack has NOT been defended successfully and the defender's gladiator token 10 is removed from arena 4 and placed back in the stable of unretained gladiators, and may be retained again by the defeated Player later if desired, in accordance with these rules, 8.) this ends the attacker's turn and play passes to the next Player.

If the attacking Player has more than one gladiator token 10 within arena 4 play progresses a little differently:

1.) the attacker activates the chance device (in the preferred embodiment the two colored dice), 2.) the attacker moves the desired amount of spaces allowed by the chance device (the pips shown on the blue die in the preferred embodiment), by any or all of his gladiator tokens 10***

3.) if the movement brings more than one gladiator tokens 10 in range for attacking an opponent's gladiator token 10, then both gladiator tokens 10 being used by the attacker are allowed the benefit of the attack. Both attacking gladiator tokens 10 use the same chance device value. The attack chance device value has already been determined (by roll of a red die in the preferred embodiment, or such other chance device as is being used), so using the number of pips shown on the red die as the base number, add any pluses that Gladiator receives due to his training and/or bonuses allowed by a trainer (see Retaining a Trainer:). An attack number for both attacking gladiator tokens 10 is determined by adding chance device value, gladiator attack points 12** and bonuses, and is the number the defending gladiator token must meet or exceed in order to prevail.

4.) the defending Player makes any statements needed to be made (see Retaining a Trainer:) at this time.

5.) the defender must then declare which attack is being defended,

6.) defender activates the chance device (the one blue die in the preferred embodiment). This is NOT a movement roll, a defender can NOT move.

7.) defender adds chance device value, gladiator defense points 14 and bonuses to arrive at a defense number, 8.) if the defense number achieved by the defender is equal to or greater than the attack number achieved by the attacker, the attack has been successfully defended. No counter-attack is allowed at this time. If the defense number achieved by the defender is NOT equal to or greater than the attack number achieved by the attacker, the attack has NOT been defended successfully and the defender's gladiator token 10 is removed from arena 4 and placed back in the stable of unretained gladiators, and may be retained again by the defeated Player later if desired, in accordance with these rules, 9.) the defender must again make any statements needed to be made (see Retaining a Trainer:) at this time, 10.) the defender must now again activate the chance device (by rolling the blue die in the preferred embodiment) to defend the attack of the second attacking gladiator token 10, 11.) the defender adds chance device value, gladiator defense points 14 and bonuses to arrive at a defense number, 12.) if the defense number achieved by the defender is equal to or greater than the attack number achieved by the attacker, the attack has been successfully defended. No counter-attack is allowed at this time. If the defense number achieved by the defender is NOT equal to or greater than the attack number achieved by the attacker, the attack has NOT been defended successfully and the defender's gladiator token 10 is removed from arena 4 and placed back in the stable of unretained gladiators, and may be retained again by the defeated Player later if desired, in accordance with these rules, 13.) this ends the attacker's turn and play passes to the next Player.

When moving and fighting within arena 3 keep in mind that all movement a Player wishes to make needs to be completed BEFORE that Player starts his attack sequence. Such Player must/may move to attack. To attack and then move is NOT allowed, and to move, attack, and then move again is NOT allowed. * Example: the blue die has four pips showing but the Player decides only to move a gladiator token 10 two of the four allowed spots. This IS allowed. The Player may also decide after viewing the result of the roll not to move at all (this ends the Players turn, he is NOT allowed to change his mind and roll the white die because he didn't like his other roll).  Example: since a Thief attacks at 1d+2 (and the 1d is the one red die), add 2 to the rolled pip(s) showing on the red die for the +2 the Thief receives due to his training. The result is the attack number need to be defended against. * Example: 2 gladiators retained by the attacking Player are in the arena and the blue die has 4 pips showing. The Player decides to move one of his gladiator tokens 10 one spot and the other gladiator token 10 three spots. This IS allowed.

Retain a Trainer Space 32:

When a player token 8 lands on this space, the Player has the opportunity to retain a trainer for a trainer fee (in the preferred embodiment the trainer fee was 300 gold). Upon payment of the trainer fee, the bank tenders a trainer token 58 to the Player. The trainer token 58 must be returned to the bank after the Player uses it. A trainer is able to impart extra training to any one Gladiator at a time of need. With the extra training received from the trainer, a gladiator token of choice is now able to attack or defend with a +2 bonus. When using the trainer in conjunction with an attack, to properly use the trainer, a Player MUST declare BEFORE rolling the dice for movement and attack within arena 4, that he is using a trainer and that Player must specify which gladiator token 10 is to receive the benefit of the bonus obtained from the trainer. When using the trainer in conjunction with a defense roll, a Player MUST declare BEFORE rolling the die for defense within the arena, that he is using a trainer and that Player must specify which gladiator token 10 is to receive the benefit of the bonus obtained from the trainer. A trainer may only be used once, it has then completed the contract for which it was retained and must be returned to the bank.

Monster Cards 50:

When a player token 8 lands on a monster card space 24, the Player owning that player token 8 must draw a card from the pile of monster cards 50 and follow the monster card instructions 52 printed on the monster card 50 drawn. The instant game includes a plurality of monster cards 50, some of which are definitely NOT good or beneficial to the Player. See Monster Card Stories which illustrates some monster card 50 possibilities.

Treasure Cards 54:

When a player token 8 lands on a treasure card space 26, the Player owning that player token 8 must draw a card from the pile of treasure cards 54 and follow the treasure card instructions 56 printed on the treasure card 54 drawn. The instant game includes a plurality of treasure cards 54, a few of which are not good or beneficial to the Player. See Treasure Card Stories which illustrates some treasure card 54 possibilities.

Unauthorized Fighting Space 30:

When a player token 8 lands on unauthorized fighting space 30, the Player who owns that player token 8 has violated the rules for proper conduct within the halls of The Arena. No fighting is allowed except in arena 4, and since the rules have been broken, an unauthorized fighting fine be paid to the bank. In the preferred embodiment, the unauthorized fighting fine was 300 gold.

Portal Space 36:

When a player token 8 lands on portal space 36, the Player who owns that player token 8 has the opportunity to teleport into arena 4 one gladiator token 10 of his choice, bypassing the need to pay the arena entrance fee. This is a risky venture because the technology allowing this has not been perfected. To use this option, the Player must first choose from his stockpile the gladiator token 10 he wishes to transport into arena 4 and place that gladiator token 10 on one of the arena 4 spots which are not safety spots 42 nor the center spot 46. The second step is to activate the change device (a white 6-sided die in the preferred embodiment). If the result of the chance device activation is within a pre-determined range of values (1–4 in the preferred embodiment) then the transport has been successful and the gladiator token 10 is now within arena 4. If the result of the chance device activation is within another pre-determined range of values (5–6 in the preferred embodiment) then that gladiator token 10 is removed from arena 4 and placed back in the stable of unretained gladiator tokens 10, and may be retained again by that Player later if desired, in accordance with these rules.

Your Best Gladiator Retires Space 34:

When a player token 8 lands on your best gladiator retires space 34, the BEST (most expensive) of gladiator tokens 10 belonging to the Player who owns that player token 8 must be retired from the game and can only be brought back in by drawing a treasure card 54 that allows one Gladiator to come out of retirement.

Special Gladiators:

Several of the Gladiators available to the player have unique specialties. The Thief has the ability to steal from the bank and can hide in thief sanctuary spots 44. To steal from the bank the Thief must on his turn be able to move within one spot of center spot 46, declare his intention to steal, give to the banker twice the amount the Thief wishes to steal, and activate the chance device (one six-sided die in the preferred embodiment). If the chance device indication falls within a predetermined range (1–4 in the preferred embodiment) the Thief has managed to successfully steal half the amount given to the banker and the banker then will return the deposit plus the amount successfully stolen. If the chance device indication falls within another predetermined range (5–6 in the preferred embodiment) the Thief has been caught. The deposit is lost and the thief gladiator token 10 is removed from arena 4 and placed back in the stable of unretained gladiator tokens 10, and may be retained again by that Player later if desired, in accordance with these rules.

The Thief also has the special ability to hide in arena 4 thief sanctuary spots 44. To do this the thief gladiator token 10 with the movement allowed by the chance device (the blue die in the preferred embodiment) moves into and out of thief sanctuary spots 44 as if such thief sanctuary spots 44 were one spot in arena 4: a grouping of four thief sanctuary spots 44 is considered to be one spot, so only one movement point is required while moving into or out of such grouping of thief sanctuary spots 44. A thief gladiator token 10 while occupying a thief sanctuary spot 44 can attack any gladiator token 10 which moves within range of such thief gladiator token 10 without having to worry about being attacked. No other gladiator token 10 may attack a thief gladiator token 10 occupying a thief sanctuary spot 44, except any other thief gladiator token. Any number of thief gladiator tokens 10 are allowed to share the same thief sanctuary spot(s) 44.

The Javelin Thrower gladiator token 10 has the ability to attack from two spots away. The Archer gladiator token 10 can attack from three spots away. Archer gladiator token 10 can team up with The Footman gladiator token 10 and receive from The Footman a defense bonus points adder of +2 defense points (but no extra attack points bonus) and a bonus for the combination of +1 to both the attack points and defense points (The Archer feels a sense of security with The Footman close there-by improving his chance to hit). That would give an Archer a combination gladiator attack point value of +4 and a combination gladiator defense point value of +6. The Footman must be on a spot adjacent The Archer for the Archer to reap this benefit.

The Longbowman gladiator token 10 can attack from four spots away. The Knight and The Squire can be teamed up in the following manner: When located on adjacent spots in arena 4, The Squire adds his gladiator attack points and gladiator defense points to his Knight's gladiator attack points and gladiator defense points with an additional +1 added to both his Knight's gladiator attack points and gladiator defense points, giving the knight an attack points of +8 and defense points of +8, that is the same as the Dragon, the most powerful of the gladiators.

Attack and Defense Chart:

This chart lists the gladiator attack points 12 and gladiator defense points 14 of representative Gladiators available to the Players. The gladiator attack points 12 and gladiator defense points 14 are the numerals following the "1d"; "1d" represents the roll value of a single six-sided die.

| Gladiator Type | Gladiator Attack Points 12 | Gladiator Defense Points 14 | Gladiator Cost in Gold to Retain |
|---|---|---|---|
| Entertainment | 1d* | 1d | 100 |
| Slave | 1d | 1d + 1** | 200 |
| Convict | 1d + 1 | 1d | 300 |
| Savage | 1d + 1 | 1d + 1 | 400 |
| Squire | 1d + 1 | 1d + 2 | 500 |
| Thief | 1d + 2 | 1d + 1 | 600 |
| Footman | 1d + 2 | 1d + 2 | 700 |
| Javlinist | 1d + 2 | 1d + 3 | 800 |
| Soldier 3rd Class | 1d + 3 | 1d + 2 | 900 |
| Archer | 1d + 3 | 1d + 3 | 1000 |
| Soldier 2nd Class | 1d + 3 | 1d + 4 | 1100 |
| Mercenary | 1d + 4 | 1d + 3 | 1200 |
| Swordsman | 1d + 4 | 1d + 4 | 1300 |
| Soldier 1st Class | 1d + 4 | 1d + 5 | 1400 |
| Long Bowman | 1d + 5 | 1d + 4 | 1500 |
| Gladiator | 1d + 5 | 1d + 5 | 1600 |
| Warlord | 1d + 5 | 1d + 6 | 1700 |
| Knight | 1d + 6 | 1d + 5 | 1800 |
| Exotic Beast | 1d + 6 | 1d + 6 | 1900 |
| Martial Artist | 1d + 6 | 1d + 7 | 2000 |
| Paladin | 1d + 7 | 1d + 6 | 2100 |
| Avatar | 1d + 7 | 1d + 7 | 2200 |
| Dragon Slayer | 1d + 7 | 1d + 8 | 2300 |
| Dragon | 1d + 8 | 1d + 7 | 2400 |

*one 6-sided die
*one 6-sided die plus the designated number

The Following Are Representative Monster Card Instructions 52:

Monster Card 1
A stressed out Slave goes berserk and slays one of your gladiators.

Monster Card 2
Move to the next Arena Entrance.

Monster Card 3
A Dragon looks deep into your eyes and you find you are frozen for the rest of this turn and your next turn.

Monster Card 4
When you land on an entrance use this to enter your gladiator for free.

Monster Card 5
After defeating a Thief who broke into your office, you find out there is a Reward on him for 200 Gold.

Monster Card 6
The Gods are in your favor you may remove from The Arena one gladiator of your choice. Return to the player's stockpile.

Monster Card 7
An angry Warlord starts whompin' on your retainers. The Doctor must be paid 150 Gold.

Monster Card 8
One of the Exotic Beasts escape because of you and the cost of recapture is 50 Gold.

Monster Card 9
Move Forward 4-spaces.

Monster Card 10
Convicted of Trespass. Pay a 150 Gold fine.

Monster Card II
A Pegasus from the Exotic Beast stables leaves you 100 Gold to help your efforts.

Monster Card 12
Move to Retain a Trainer.

Monster Card 13
When you land on an entrance use this to enter your gladiator for free.

Monster Card 14
Move back 4-spaces.

Monster Card 15
Move backwards next turn.

Monster Card 16
A Cheetah Priest tells you your turn stops NOW! Then he declares you must START your turn over.

Monster Card 17

Move to the next
Arena Entrance.
Pay 100 gold to
enter a gladiator.

Monster Card 18
A wild boar escapes
the cage. After you
help re-capture it,
a Slave pays his own
retainer fee and joins
your stockpile.

Monster Card 19
A Kipador escapes
the Exotic Beast
cage and you
receive 100 Gold
for it's recapture.

Monster Card 20
Porthath the Paladin
gets drunk while
playing dice and you
win 50 Gold.

Monster Card 21
One of your best
swords break and
it costs you
100 Gold
to replace it.

Monster Card 22
Choose a Gladiator!
Roll the red and blue
die if the blue die is
equal to or greater than
the red die you saved
your gladiator.

Monster Card 23
A Rinobrogo breaks
into The Arena and
stomps on your best
gladiator. Return
to your stockpile.

Monster Card 24
A Griffin attacks
your retainers.
Doctor fees of
150 Gold
must be paid.

Monster Card 25
A Hopalog escapes
and you are blamed.
you must pay 50 Gold.

Monster Card 26
A Pegasus visits
your kitchen and
eats up 100 Gold
worth of food.

Monster Card 27
A Kipador escapes
when you open the
cage the recapture
costs 100 Gold.

Monster Card 28
A Barker Beast
goes on a rampage
and slays one of
your gladiators.

Monster Card 29
You trip an alarm
and are charged
200 Gold reset fee.

Monster Card 30
The Dragon Galbrien
wins at dice.
You Pay him
50 Gold.

Monster Card 31
A Tantrill goes
berserk and you
lose your BEST
gladiator.

Monster Card 32
A Pycotes breaks
into your office.
Repairs cost
200 Gold.

Monster Card 33
After helping a Knight
he rewards you by
slaying one of your
gladiators.

The Following Are Representative Treasure Card Instructions 56:

Treasure Card 1
After breaking up
an unauthorized
fight, you find a
small sack holding
150 Gold.

Treasure Card 2
After helping a
Knight he rewards
you with 50 Gold.

Treasure Card 3
You receive
1-trainer free of charge.

Treasure Card 4
A Convict likes
your style, so
he paid his own
retainer fee and
joins your service.

Treasure Card 5
You find Draks
Broadsword and he
gives you 50 Gold.

Treasure Card 6
After knocking a
brick loose you
find 150 Gold.

Treasure Card 7
An Entertainer pays his own retainer fee and joins you.

Treasure Card 8
A gleam from the floor draws your eye and you find a sapphire worth 200 Gold.

Treasure Card 9
A blue diamond is shining from a crack. It brings you 200 gold when sold.

Treasure Card 10
You sell some old armour and receive 100 Gold.

Treasure Card 11
You receive 1-trainer free of charge.

Treasure Card 12
Bring one of your gladiators out of retirement.

Treasure Card 13
One of your gladiators trip a spike trap and dies.

Treasure Card 14
You lose one of your gladiators in a rockslide.

Treasure Card 15
One of your gladiators fall in a pit trap and dies.

While a preferred embodiment of the invention has been illustrated herein, it is to be understood that changes and variations may be made by those skilled in the art without departing from the spirit of the appending claims.

For example, a video game version, a computer game version, and an internet game version which can be played by large number of players are all considered to be within the scope of this disclosure. Any player can join into play at any time by paying the bank.

DRAWING ITEM INDEX

2 game environment
4 arena
6 perimeter path
8 player token
10 gladiator token
12 gladiator attack points
14 gladiator defense points
20 main office space
21 gladiator name
22 gladiator space
23 gladiator cost
24 monster card space
26 treasure card space
28 entrance space
30 unauthorized fighting space
32 retain a trainer space
34 your best gladiator retires space
36 portal space
40 entrance spot
42 safety spot
44 thief sanctuary spot
46 center spot
50 monster card
52 monster card instructions
54 treasure card
56 treasure card instructions
58 trainer token

I claim:

1. A method of play for a gladiator game, said gladiator game comprising a plurality of player tokens, a plurality of gladiator tokens associated with each said player token, at least one chance device, and a game environment comprising an arena and a perimeter path, said arena comprising a plurality of spots, said perimeter path comprising a plurality of gladiator spaces and at least one entrance space through which said gladiator tokens may enter said arena, said method of play comprising the steps of:

A. Moving at least two opposing gladiator tokens into said arena through said at least one entrance space;

B. Moving one said gladiator token into attack range from another said gladiator token;

C. Activating said chance device and noting its attack points value;

D. Activating said chance device and noting its defense points value;

E. If said attack points exceed said defense points, removing the defending gladiator token from play.

2. The method of play for a gladiator game of claim 1 wherein each said gladiator token comprises a gladiator attack points value and a gladiator defense points value, and wherein said method of play comprises the further steps of adding said gladiator attack points to said chance device attack points to determine an attack number, adding said gladiator defense points to said chance device defense points value to determine a defense number, and if said attack number exceeds said defense number, removing the defending gladiator token from play.

3. The method of play for a gladiator game of claim 1 wherein said gladiator game further comprises play money and a gladiator value associated with each said gladiator token, said method of play comprising the further step of purchasing at least one gladiator token using said play money.

4. The method of play for a gladiator game of claim 3 wherein each said gladiator space contained in said perimeter path is associated with at least one said gladiator token, and wherein said method of play comprises the further step of purchasing a given gladiator token only when one said player tokens occupies the gladiator space associated with the given gladiator token.

5. The method of play for a gladiator game of claim 1 wherein said gladiator game further comprises play money and said arena further comprises a center spot, and any gladiator token occupying such center spot earns a center spot payment each turn during which said gladiator token occupies such center spot.

6. The method of play for a gladiator game of claim 1 wherein said gladiator game further comprises a plurality of monster cards bearing monster card instructions, and said perimeter path comprises at least one monster card space, and wherein said method of play comprises the further step of drawing a monster card and following its monster card instructions each time one said player token lands on said at least one monster card space.

7. The method of play for a gladiator game of claim 6 wherein said gladiator game further comprises a plurality of treasure cards bearing treasure card instructions, and said perimeter path comprises at least one treasure card space, and wherein said method of play comprises the further step of drawing a treasure card and following its treasure card instructions each time one said player token lands on said at least one treasure card space.

8. The method of play for a gladiator game of claim 7 wherein said game environment further comprises a main office space, and wherein said method of play comprises the further step of entering at least one said gladiator token into said arena through said main office space free of charge.

9. The method of play for a gladiator game of claim 8 wherein said game environment further comprises at least one unauthorized fighting space, and wherein said method of play comprises the further step of charging an unauthorized fighting fine of each said gladiator token which lands on said unauthorized fighting space.

10. The method of play for a gladiator game of claim 9 wherein said game environment further comprises at least one your best gladiator retires space, and wherein said method of play comprises the further step of withdrawing from play a gladiator having a highest gladiator cost owned by a player who owns the gladiator token which landed on said your best gladiator retires space.

11. The method of play for a gladiator game of claim 10 wherein said game environment further comprises at least one portal space, and wherein said method of play comprises the further steps of moving at least one gladiator token onto said portal space, activating said at least chance device, and entering said at least one gladiator token into said arena at no charge if one or more pre-determined chance device value is achieved.

12. The method of play for a gladiator game of claim 11 comprising the further step of withdrawing from play the at least one gladiator token which landed on said portal space if one or more pre-determined chance device value is achieved.

13. The method of play for a gladiator game of claim 1 wherein said arena further comprises at least one safety spot wherefrom no said gladiator token may attack, and wherein no said gladiator token may be attacked.

14. The method of play for a gladiator game of claim 8 wherein said gladiator game comprises at least one Thief gladiator token and said arena further comprises at least one thief sanctuary spot, wherein no said Thief gladiator token may be attacked except by another said Thief gladiator token.

15. The method of play for a gladiator game of claim 2 wherein said perimeter path further comprises at least one retain a trainer space and at least one trainer token, and wherein said method of play comprises the steps of moving at least one said gladiator token onto said retain a trainer space, purchasing a trainer token, adding a pre-determined number of training points to said gladiator attack and said chance device attack points to determine said attack number, and adding a pre-determined number of training points to said gladiator defense points and to said chance device defense points value to determine said defense number.

16. A gladiator game comprising a plurality of player tokens, a plurality of gladiator tokens associated with each said player token, at least one chance device, and a game environment comprising an arena and a perimeter path, said arena comprising a plurality of spots, said perimeter path comprising a plurality of gladiator spaces and at least one entrance space through which said gladiator tokens may enter said arena.

17. The gladiator game of claim 16 wherein each said gladiator token comprises gladiator attack points and gladiator defense points.

18. The gladiator game of claim 17 further comprising a plurality of monster cards bearing monster card instructions, and said perimeter path further comprises at least one monster card space.

19. The gladiator game of claim 18 further comprising a plurality of treasure cards bearing treasure card instructions, and said perimeter path further comprises at least one treasure card space.

20. The gladiator game of claim 19 further comprising play money and a center spot in said arena, whereby one said gladiator tokens occupying said center spot may earn at least one center spot payment.

21. The gladiator game of claim 20 wherein said arena comprises at least one safety spot wherein said gladiator tokens may not be attacked.

22. The gladiator game of claim 21 wherein said arena comprises at least one thief sanctuary spot wherein a thief gladiator token may not be attacked.

* * * * *